US007775013B2

(12) United States Patent
Bartlett et al.

(10) Patent No.: US 7,775,013 B2
(45) **Date of Patent: *Aug. 17, 2010**

(54) DOOR EDGE CONSTRUCTION

(75) Inventors: Gary F. Bartlett, Muncy, PA (US); Wendy Duckham, Oxfordshire (GB)

(73) Assignee: Construction Specialties, Inc., Lebanon, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/615,607

(22) Filed: Dec. 22, 2006

(65) Prior Publication Data

US 2007/0113521 A1 May 24, 2007

Related U.S. Application Data

(62) Division of application No. 10/686,325, filed on Oct. 14, 2003, now Pat. No. 7,621,102.

(51) Int. Cl.
*E04C 2/38* (2006.01)

(52) U.S. Cl. ..... 52/800.11; 52/800.1; 52/802.1; 52/717.01

(58) Field of Classification Search ..... 52/784.1, 52/784.13, 797.1, 798.1, 800.1, 800.11, 800.12, 52/800.13, 800.17, 800.18, 802.1, 802.11
See application file for complete search history.

(56) References Cited

U.S. PATENT DOCUMENTS

| | | | | |
|---|---|---|---|---|
| 1,270,011 | A | 6/1918 | Conwell | |
| 1,587,771 | A | 6/1926 | Goddard | |
| 1,694,522 | A * | 12/1928 | Victor | 52/784.1 |
| 2,399,666 | A | 5/1946 | Brynjulvsen Een | |
| 2,564,386 | A * | 8/1951 | Webb | 5/93.1 |
| 2,646,325 | A | 7/1953 | Abrahamson | |
| 2,827,670 | A | 3/1958 | Schwindt | |

(Continued)

FOREIGN PATENT DOCUMENTS

| | | |
|---|---|---|
| DE | 19620474 | 11/1997 |

(Continued)

OTHER PUBLICATIONS

"Total Surface Protection," 4 pages, Harrison Thomson & Co., Ltd., Whitehall road, Leeds LS12 5JB.

(Continued)

*Primary Examiner*—Richard E Chilcot, Jr.
*Assistant Examiner*—Ryan D Kwiecinski
(74) *Attorney, Agent, or Firm*—Baker Botts LLP

(57) ABSTRACT

A door is constructed with a separate member joined to the door edge by a tongue-and-groove coupling and screws so as to be readily removable and replaceable. The separate member sustains the impacts imparted to the door by carts or wagons pushed past the door and can be readily replaced when damaged, thus avoiding replacement of the entire door. A flexible cover snaps over the outer surface of the separate member to add impact resistance and aesthetic appeal. Intumescent strips may be inserted inside or outside of the cover to enhance sealing between the door, and as adjacent door or door frame, thereby improving the fire resistance rating of the door. Accent strips or reveals of contrasting or complementary colors may be incorporated to add to the aesthetic appeal of the door. The door construction is of particular utility in schools, health care facilities and other institutions.

29 Claims, 8 Drawing Sheets

U.S. PATENT DOCUMENTS

| | | | | | |
|---|---|---|---|---|---|
| 2,833,004 | A | | 5/1958 | Johnson et al. | |
| 3,001,246 | A | | 9/1961 | Mather | |
| 3,271,919 | A | * | 9/1966 | Olton | 52/800.13 |
| 3,349,533 | A | | 10/1967 | Gregoire | |
| 3,363,390 | A | | 1/1968 | Crane et al. | |
| 3,401,487 | A | | 9/1968 | Brandt et al. | |
| 3,416,282 | A | | 12/1968 | Daugherty | |
| 3,458,955 | A | | 8/1969 | Brooks | |
| 3,780,472 | A | | 12/1973 | Biebuyck | |
| 3,885,351 | A | | 5/1975 | Imperial et al. | |
| 3,994,110 | A | | 11/1976 | Ropella | |
| 4,001,974 | A | | 1/1977 | Wright | |
| 4,104,838 | A | | 8/1978 | Hage et al. | |
| 4,242,848 | A | * | 1/1981 | Schoultz | 52/717.06 |
| 4,259,812 | A | | 4/1981 | Adell | |
| 4,386,482 | A | | 6/1983 | Quinif | |
| 4,649,089 | A | | 3/1987 | Thwaites | |
| 4,663,912 | A | * | 5/1987 | Vinther | 52/797.1 |
| 4,748,780 | A | | 6/1988 | Vinther | |
| 4,807,396 | A | | 2/1989 | Heikkinen | |
| D313,858 | S | | 1/1991 | Whitney | |
| 5,077,948 | A | | 1/1992 | Olson et al. | |
| D323,715 | S | | 2/1992 | Bodurow et al. | |
| 5,184,441 | A | * | 2/1993 | Balfanz, Jr. | 52/241 |
| 5,214,880 | A | | 6/1993 | Woodruff et al. | |
| 5,548,928 | A | | 8/1996 | Chen | |
| 5,839,252 | A | | 11/1998 | Berghorn et al. | |
| D423,690 | S | | 4/2000 | Grosfillex | |
| 6,115,976 | A | | 9/2000 | Gomez | |
| 6,189,273 | B1 | | 2/2001 | Larson | |
| 6,434,899 | B1 | | 8/2002 | Fortin et al. | |
| 6,453,638 | B2 | * | 9/2002 | Chen | 52/784.15 |
| 6,619,005 | B1 | * | 9/2003 | Chen | 52/455 |
| 6,643,991 | B1 | * | 11/2003 | Moyes | 52/784.11 |
| 6,668,499 | B2 | | 12/2003 | Degelsegger | |
| 6,745,526 | B1 | | 6/2004 | Autovino | |
| 7,587,876 | B2 | | 9/2009 | Bartlett | |
| 2001/0045080 | A1 | | 11/2001 | Chen | |
| 2002/0100250 | A1 | | 8/2002 | Hirath et al. | |
| 2002/0121071 | A1 | | 9/2002 | Heung Bin | |
| 2002/0124497 | A1 | * | 9/2002 | Fortin et al. | 52/232 |
| 2003/0145542 | A1 | * | 8/2003 | Chen | 52/309.9 |
| 2006/0272247 | A1 | | 12/2006 | Barlett et al. | |

FOREIGN PATENT DOCUMENTS

| | | |
|---|---|---|
| FR | 2742186 | 6/1997 |
| GB | 2197372 | 5/1988 |
| GB | 2278140 | 11/1994 |
| GB | 2289700 | 11/1995 |
| GB | 2330855 | 5/1999 |
| GB | 2365054 | 2/2002 |

OTHER PUBLICATIONS

"Door Edge Protectors: Yeoman Shield: Total Surface Protection: Door Protection," 3 pages, Harrison Thomson & Co., Ltd., Whitehall road, Leeds LS12 5JB.

* cited by examiner

DOOR EDGE CONSTRUCTION

CROSS-REFERENCE TO RELATED APPLICATION

This application is a divisional application of U.S. patent application Ser. No. 10/686,325, filed Oct. 14, 2003 now U.S. Pat. No. 7,621,102, which is hereby incorporated by reference in its entirety.

FIELD OF THE INVENTION

The present invention relates generally to door constructions and more particularly, to replaceable door edge arrangements.

BACKGROUND OF THE INVENTION

One popular form of vertically hung doors typically comprises a wooden frame defining outer dimensions of the door, panels of sheet material, such as plywood, plastic or metal covering the frame or both sides, and a core within the frame, which may be solid or hollow.

In certain high traffic environments, for example, schools, hospitals and other types of health care institutions, doors are often subjected to impacts from carts, wagons, dollies, etc. which take their toll on the doors, particularly along their free edges and the hinged edges. Nicks, gouges and cracks produced along door edges by such impacts compromise a door's ability to effect a secure closure, which is particularly important where the door serves as a fire barrier as well as a closure, and mar its aesthetic appearance.

Heretofore, when a door edge was severely damaged, it was necessary either to replace the door in its entirety or to refinish it. With the latter expedient, the door panels may also have to be replaced and, in any event, the door will have to be refinished as well. The cost of maintaining the structural integrity and appearance of the many doors in a hospital, for example, can become substantial.

SUMMARY OF THE INVENTION

The object of the present invention is to minimize the necessity of replacing or refinishing doors that have been severely damaged along their edges by enabling a damaged door edge to be simply and inexpensively restored.

The foregoing object is achieved by constructing a door with a replaceable edge strip or stile which, when damaged, can be readily removed and replaced with a new one, thereby restoring the door's integrity and appearance. In accordance with the invention, this is achieved by so constructing the door such that the replaceable edge strip or the replaceable stile can be removed and replaced without affecting the door frame or door slab, thus eliminating the need for otherwise replacing or refinishing the door. The stile is so configured that it can be covered with a plastic cap that provides an extra layer of protection against damage and helps maintain a snug seal against a doorway or an opposite door.

Another feature of the invention is the incorporation in the replaceable door edge assembly of an intumescent (heat expanding) material such that in case of fire, the edge is expanded outwardly to effect a tighter seal with the surrounding doorway or opposite door. The fire safety rating of the door is thus improved.

Still another feature of the invention is the incorporation in the door edge construction of an accent material to provide a reveal, or line of color different than the door panel color, for aesthetic and/or identification purposes.

BRIEF DESCRIPTION OF THE DRAWINGS

The foregoing and other features and advantages of the invention will become apparent from the following detailed description thereof, taken in conjunction with the appended drawing, in which.

DETAILED DESCRIPTION OF THE INVENTION

Figure 1:
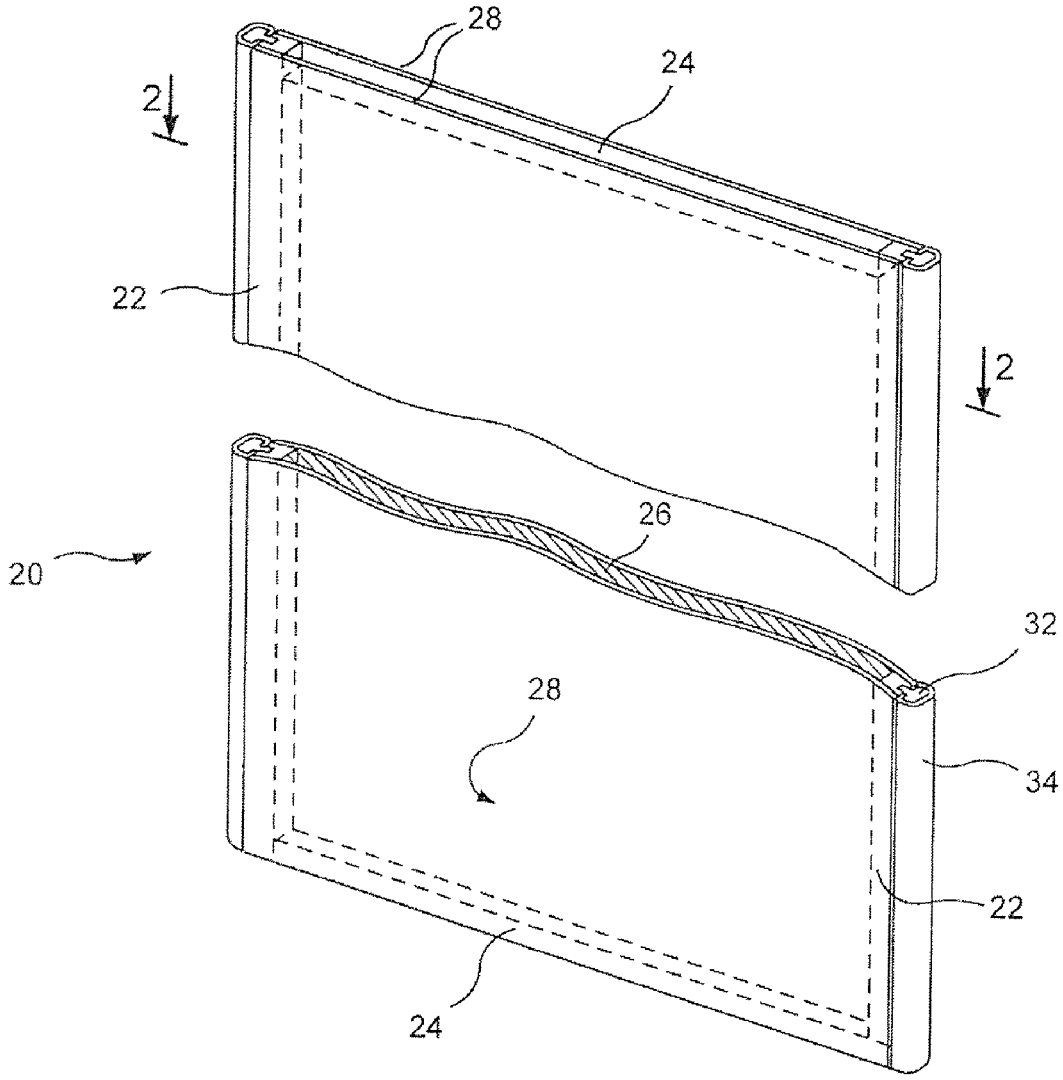
FIG. 1 is an oblique view partially cut away, of a door incorporating the present invention.
Figure 2:
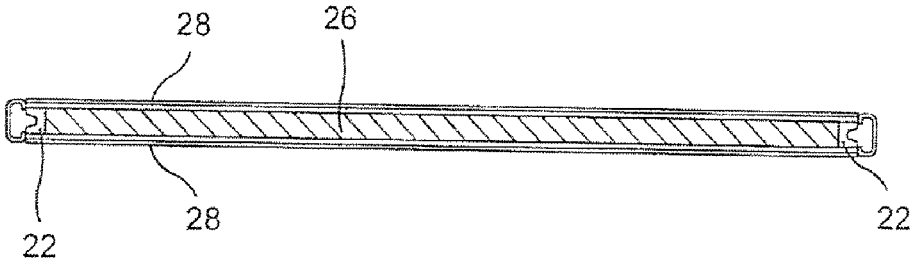
FIG. 2 is a cross-section of the door of FIG. 1, taken along the line 2-2.
Figure 3:
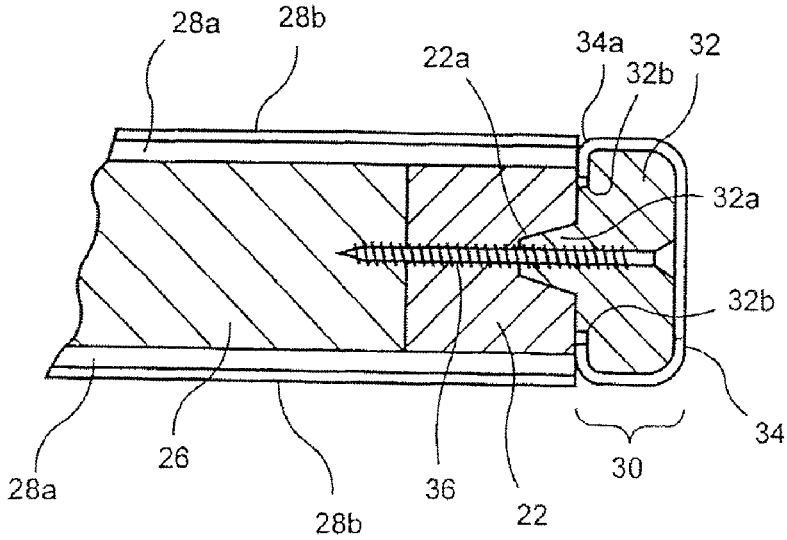
FIG. 3 is an enlarged view of the right-hand portion of the cross-section view of FIG. 2 showing the door edge construction of the invention in greater detail.

Turning now to the drawings, in particular FIGS. 1, 2 and 3, a door of the type commonly used in health care facilities and the like, but incorporating the present invention, is shown. Such a door 20 typically comprises vertical stiles 22 and top and bottom rails 24, surrounding a core 26. The stiles 22 and rails 24 preferably are made of hardwood and the core 26 of particle board, although other materials may be used to provide the necessary strength and rigidity.

Finish panels 28 cover the particle board core, top and bottom rails and stiles on both sides to provide strength, impact resistance and aesthetic appeal. As seen best in FIG. 3, the panels 28 may comprise a hardboard layer 28*a* covered by a decorative plastic cladding 28*b* such as of ACROVYN®, a vinyl acrylic plastic manufactured by Construction Specialties, Inc., Lebanon, N.J. The layers 26, 28*a* and *b* are laminated together to form a 5-ply construction. Doors of the type illustrated are manufactured, for example, by Jeld-Wen, Inc.

Doors 20 may be made in dimensions to fit various size doorways in which they are mounted. As will be appreciated, the door 20 may be hinged to swing around along either vertical edge to suit the application. In a typical installation often found in health care facilities, a pair of such doors are hinged at opposite edges to close a wide hallway and are swingable in both directions so that rolling beds, carts, etc may be pushed through without the need to hold the door open.

As discussed above, such doors are subjected to repeated, severe impact by beds, carts, etc., as they are pushed through the doors, often resulting in significant damage to the free vertical edges of the doors. Not only is the appearance of the door thus marred, the integrity of the closure and its fire resistance capability is degraded. Heretofore, in the case of significant edge damage, it was necessary to completely replace a damaged door with a new one to restore the closure's appearance and integrity, at substantial cost.

In accordance with the present invention, the vertical edges of a door such as described herein are fabricated with separable edge assemblies that can be readily replaced if damaged, thereby avoiding the necessity of complete door replacement and greatly reducing the cost of restoring the door's appearance and integrity.

A preferred embodiment of the removal door edge arrangement of the invention is shown in FIGS. 1, 2 and 3; most clearly in the enlarged section through a door edge of FIG. 3. The vertical door stile is indicated at 22 and the replaceable edge assembly indicated at 30. The latter comprises replaceable stile 32, preferably of hardwood, extending the full length of the edge stile 22 and a plastic cover 34 secured over replaceable stile 32. Stile 22 is milled with a longitudinal tapered grove 22*a* and replaceable stile 32 with a longitudinally extending complementary tapered spline 32*a*, forming a snug tongue-and-groove mating of stile 22 and replaceable stile 32. A plurality, e.g., 4, of screws 36, spaced along the door edge, firmly but releasably secure replaceable stile 32 to stile 22. If desired, spots of glue may also be applied between stile 22 and replaceable stile 32 to more firmly hold them together, while still allowing replaceable stile 32 to be removed when required.

Cover 34 may be formed of ACROVYN® or other relatively hard but resilient material, such as aluminum or stainless steal, with inwardly directed flanges 34*a* along both edges. Cover 34 is formed to be of the same shape as the outer surface of replaceable stile 32, e.g., generally rectangular with rounded corners. Replaceable stile 32 is provided with rectangular indents 32*b* along both inner longitudinal edges, such that when stile 22 and replaceable stile 32 are joined, rectangular grooves 32*b* are formed therebetween extending the full length of the door. These grooves snugly receive the flanges 34*a* of cover 34. To remove a damaged cover from a door, one of the flanges 34*a* is pried out of its groove and the cover bent away to release the other flange. To install a new cover, one of the flanges is inserted into its groove and the cover pressed toward the outer surface of replaceable stile 32 until the other flange snaps into the other groove.

It will be understood that the curvature of the corners of the stile and cover combination discussed and illustrated may be varied to suit the particular application. For example, for paired swinging doors, such as often found across hospital passageways, the corner curvature will be of greater radius than single doors, to provide the required clearance.

It will also be understood that the cover 34 need not be removable, but may be permanently secured to its replaceable stile 32, such as by a suitable adhesive. In such an arrangement, flanges 34*a* and indents 32*b* may be unnecessary.

Figure 4A:
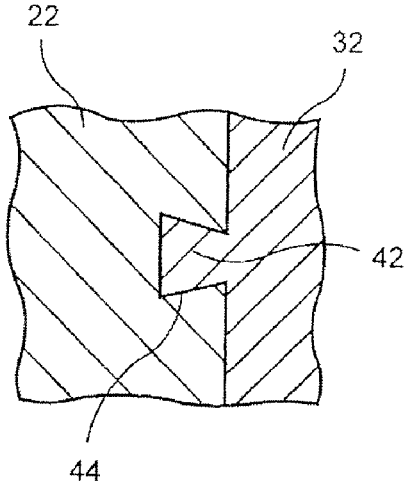
FIGS. 4A, 4B and 4C illustrate modifications of the door edge construction of FIG. 3.
Figure 4B:
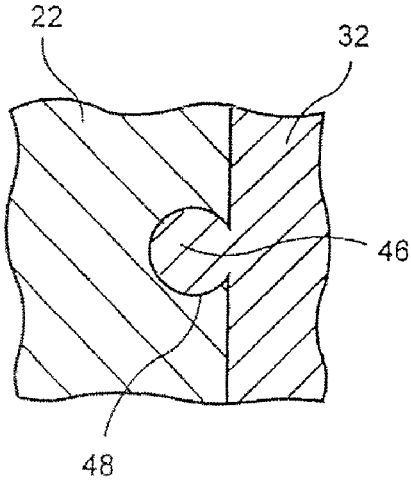
Figure 4C:
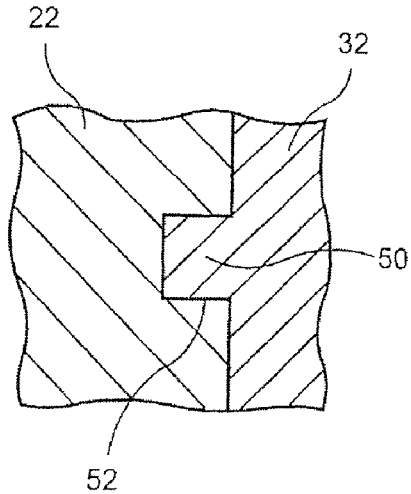

FIGS. 4A, 4B and 4C illustrate alternative forms of the tongue-and-groove coupling of FIG. 3, with the screws omitted for the sake of clarity. In FIG. 4A, a dovetail spline 42 mates with a corresponding grove 44; in FIG. 4B, the spline 46 has a partially circular cross-section to mate with a partially circular groove 4B; and in FIG. 4C, the spline 50 and groove 52 are rectangular in cross-section. It will be understood that other variations of the tongue-and-groove cross-sections may be used as desired.

Figure 5:
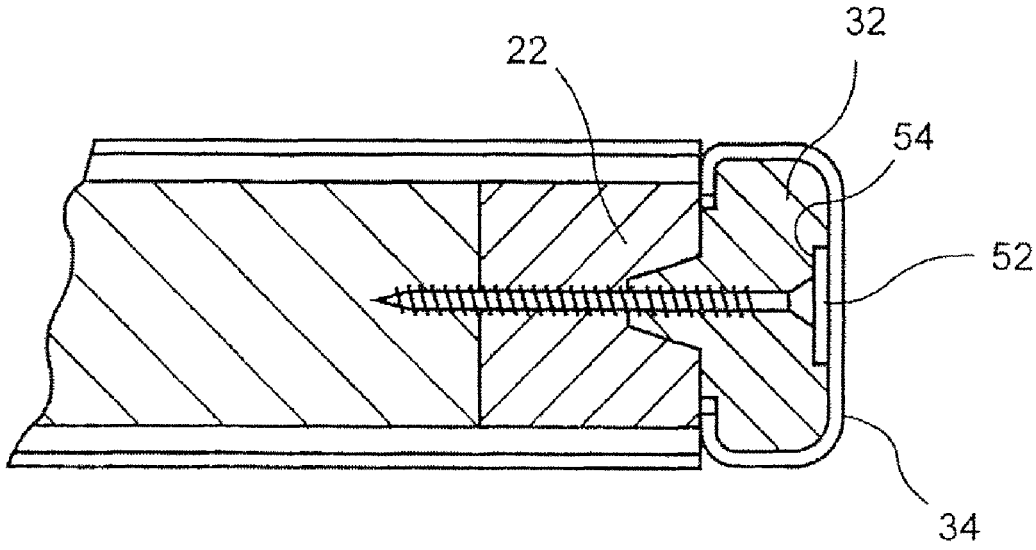
FIG. 5 is an enlarged cross-sectional view similar to FIG. 3 illustrating the incorporation of an intumescent strip in the door edge construction of the invention.

FIG. 5 illustrates another embodiment which further enhances the fire resistance advantages of doors of the invention. A heat-expansion or intumescent strip 52 extends the full length of the door edge and is adhered in a groove 54 milled along the outer edge of replaceable stile 32. Cover 34 may have a complementary groove along its inner surface to accommodate the strip as well. The strip 52 is covered by outer cover 34 when the latter is snapped in place. At normal room temperatures, strip 52 maintains its normal thickness. In case of fire or extreme heat adjacent the door, strip 52 expands, pushing cover 34 outwardly to tighten the seal between the edge of the door and an adjacent door or doorframe, thus increasing the fire resistance rating of the door.

Figure 6:
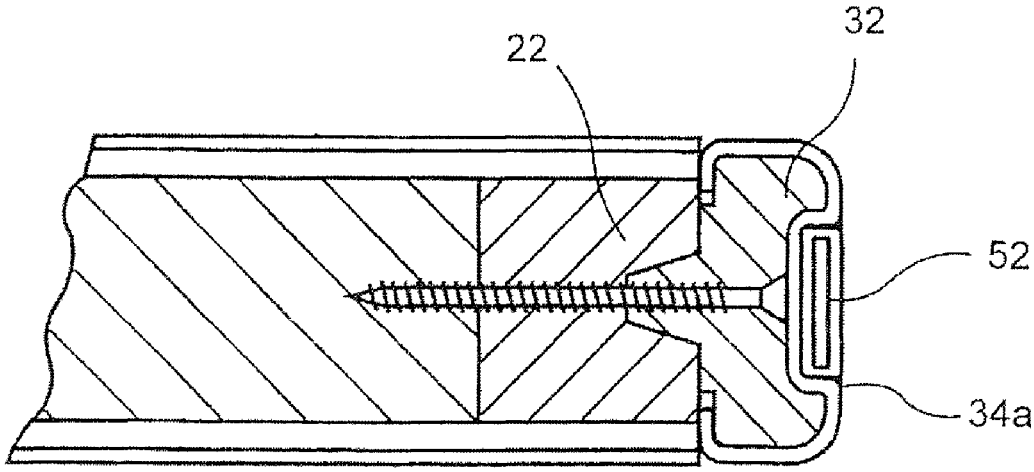
FIG. 6 illustrates a modification of the door edge construction of FIG. 5.

A variation of the arrangement of FIG. 5 is illustrated in FIG. 6 wherein the intumescent strip 52 is adhered in a groove 34*a* formed in the outer edge of cover 34, the inward extension of the cover 34 fitting in a groove milled along the outer edge of replaceable stile 32.

It will be understood that in the embodiments of FIGS. 5 and 6, any of the tongue-and-groove couplings described above may be used in place of the configurations illustrated.

Figure 7A:
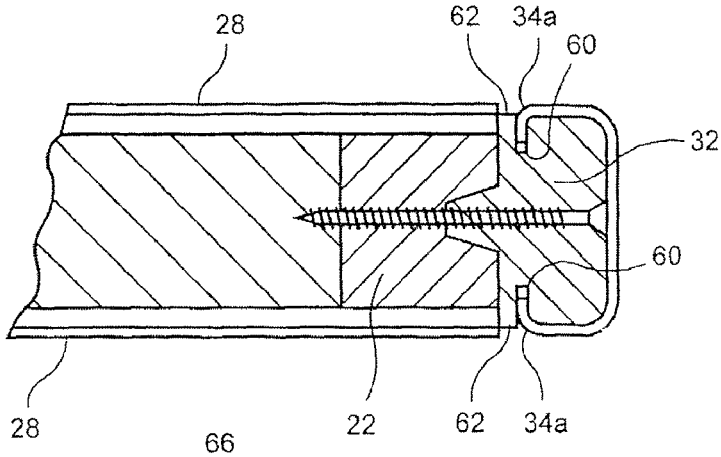
FIGS. 7A, 7B, 7C and 7D illustrate the replaceable door edge construction of the invention incorporating various types of accent strips or reveals

To improve the appearance of the door, an accent strip or reveal, of a contrasting or complementary color to the remainder of the door surface, may be incorporated in the door edge arrangements of FIGS. 3 to 6. In the embodiment of FIG. 7A, longitudinal grooves 60 are milled along opposite sides of replaceable stile 32, inwardly of its interior face, for receiving the flanges 34*a* of cover 34, leaving exposed narrow longitudinal surfaces 62 on opposite sides of the stile, between cover 34 and the panels 28. These exposed surfaces 62 may be painted in any aesthetically pleasing color.

Figure 7B:
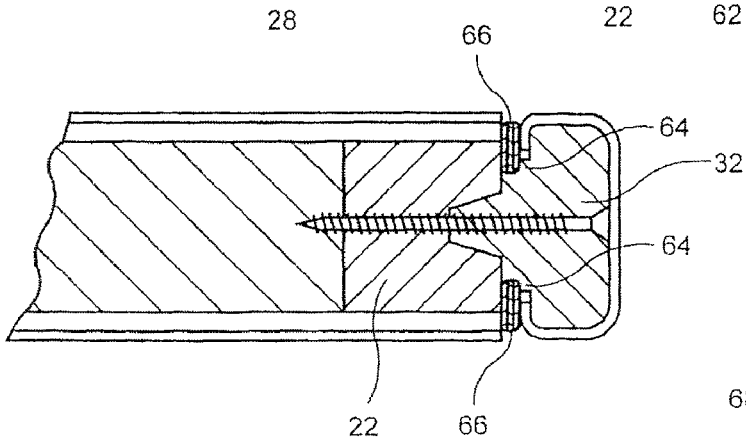

The reveal or accent strip may also be provided by insertion of a suitably colored strip of accent material in a slot provided between the stile 22 and replaceable stile 32, as shown in FIG. 7B. As seen, stepped indents 64 are provided along each inner corner of replaceable stile 32 to receive the flanges of cover 34 and accent strips 66. The strips 66 may be of PVC plastic, aluminum, stainless steel or other material having their outer surfaces ridged and slightly thicker than the grooves created upon joinder of replaceable stile 32 to stile 22. The strips 66 are pressed into the grooves after cover 34 is inserted and the ridged surfaces resist any tendency of the strips to move out of the grooves.

Figure 7C:
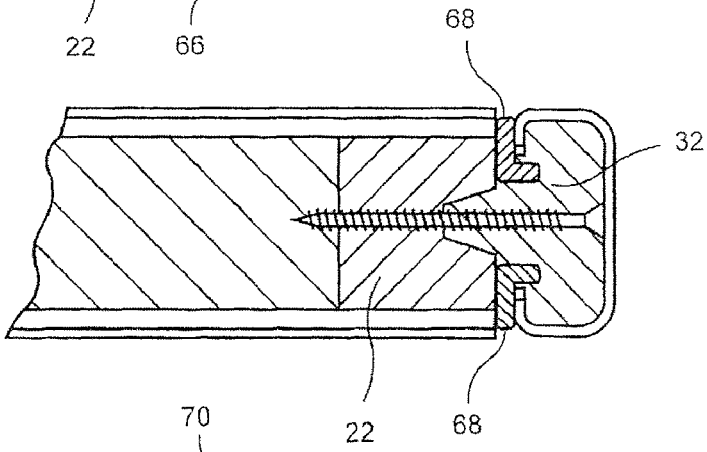

A variation of the accent strip of FIG. 7B is illustrated in FIG. 7C. In this modification, the inside longitudinal edges of replaceable stile 32 are milled to provide both stepped indents and longitudinal grooves for receiving L-shaped accent strips 68. One leg of each accent strip extends outwardly to just below the respective outer surface of the door with its edge exposed when replaceable stile 32 is joined to stile 22 with the accent strip in place.

Figure 7D:
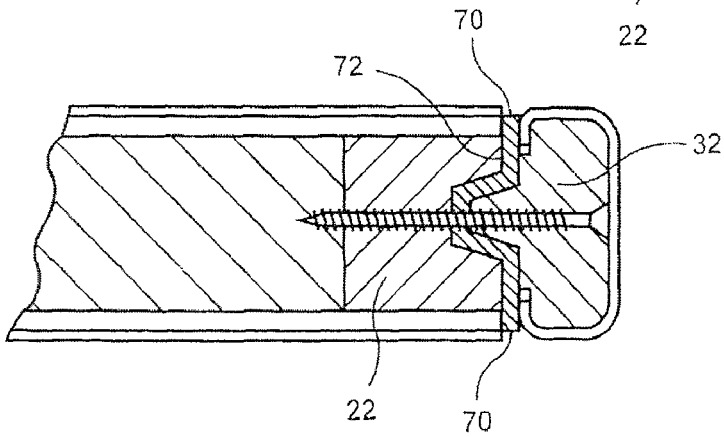

In the embodiment of FIG. 7D, the accent strips comprise opposite exposed edges 70 of a strip 72 sandwiched between stile 22 and replaceable stile 32.

The accent strips of FIGS. 7B-D may be made of any suitable material, including PVC plastic, aluminum and stainless steel.

Figure 8A:
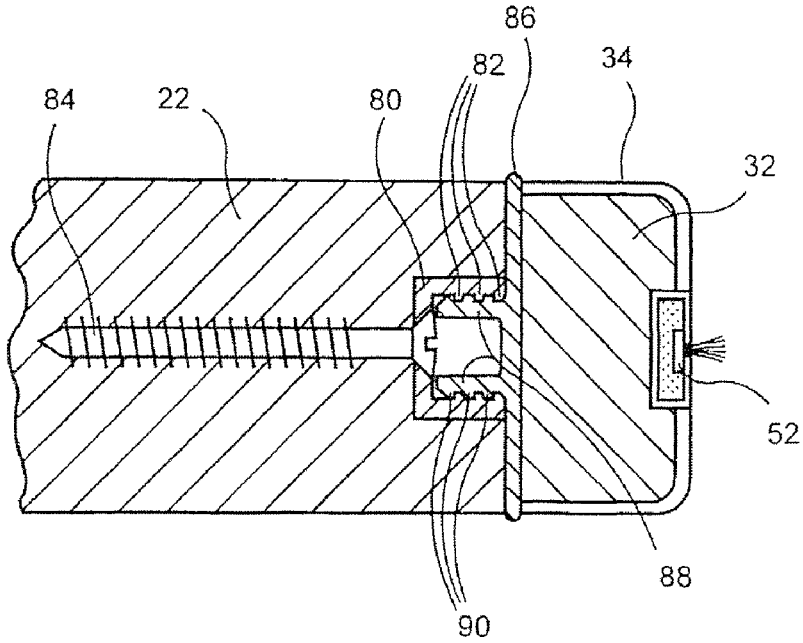
FIGS. 8A and 8B illustrate variations of the invention embodying an alternate tongue and groove arrangement for securing the replaceable stile to the door edge.
Figure 8B:
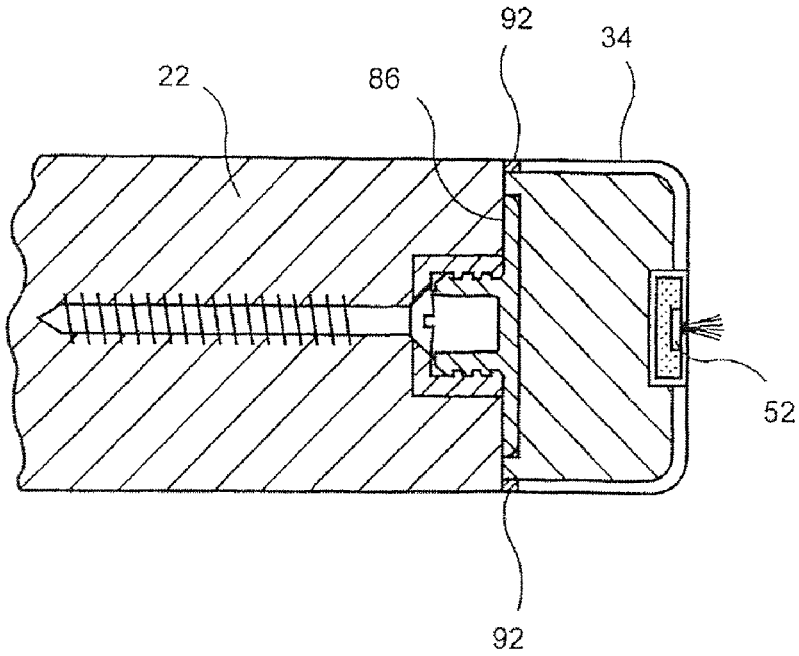

FIGS. 8A and 8B illustrate variations of the tongue and groove arrangements of the invention shown in the previous embodiments. In both variations, the groove in the stile 22 is rectangular (as in FIG. 4C) and lined with a U-shaped channel 80 having longitudinal ridges 82 formed along both interior sides of the channel. Channel 80 is secured in the rectangular groove milled in stile 22 by screw 84.

Adhered along the inner surface of replaceable stile 32 is a tongue plate 86 having integral longitudinal extending flanges 88 with longitudinally extending ridges 90 formed along their outer surfaces. The pair of flanges 88 and channel 80 are dimensioned such that the flanges are snugly received within the channel and the respective ridges 82, 90 engaged to secure replaceable stile 32 to stile 22. Tongue plate 86 may extend the full width of stile 32, with rounded edges extending slightly beyond the door panel as in FIG. 8A, or be narrower than the width of the stile and received in a depression milled in the inner surface of replaceable stile 32, as in FIG. 8B. In the embodiment of FIG. 8A, the rounded extensions of the tongue plate 86 may serve as accent strips. In FIG. 8B, accent strips are provided by inserts 92 between the edges of cover 34 and stile 22. In both embodiments, intumescent strips 52 may be provided.

Channel 80 and tongue plate 86 may be made of aluminum or other metal or plastic, as desired.

Figure 9:
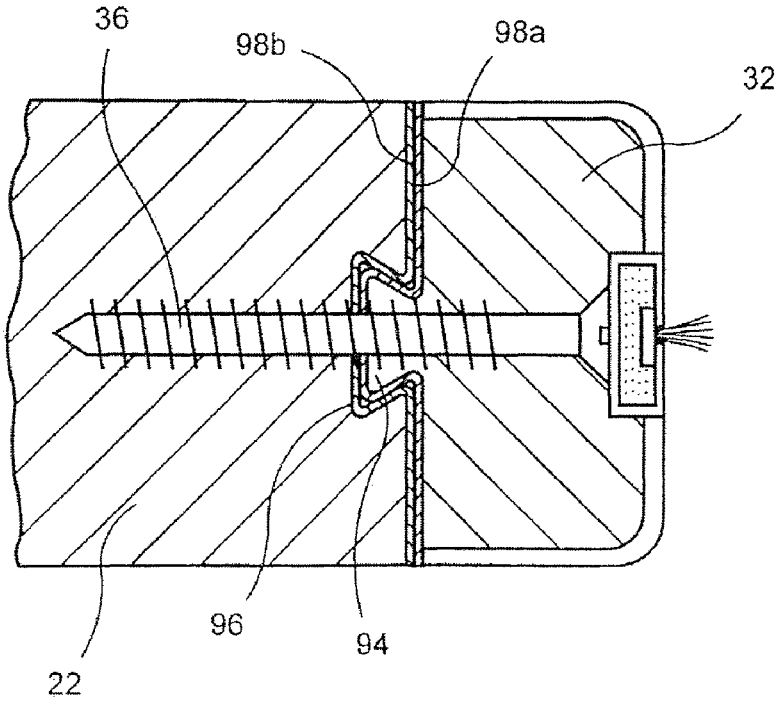
FIG. 9 illustrates a variation of the invention in which the tongue and groove members are covered with metal channels.

In the embodiment of FIG. 9, a dovetail tongue and groove coupling between stile 22 and replaceable stile 32, such as shown in FIG. 4A, has both tongue 94 and groove 96 covered with channels of this aluminum, steel, or other material providing low friction slideable surfaces, 98*a* and 98*b*, respectively, which extended to the outer surfaces of the door. The covered channels facilitate the insertion and removal of replaceable stile 32 on stile 22.

Figure 10:
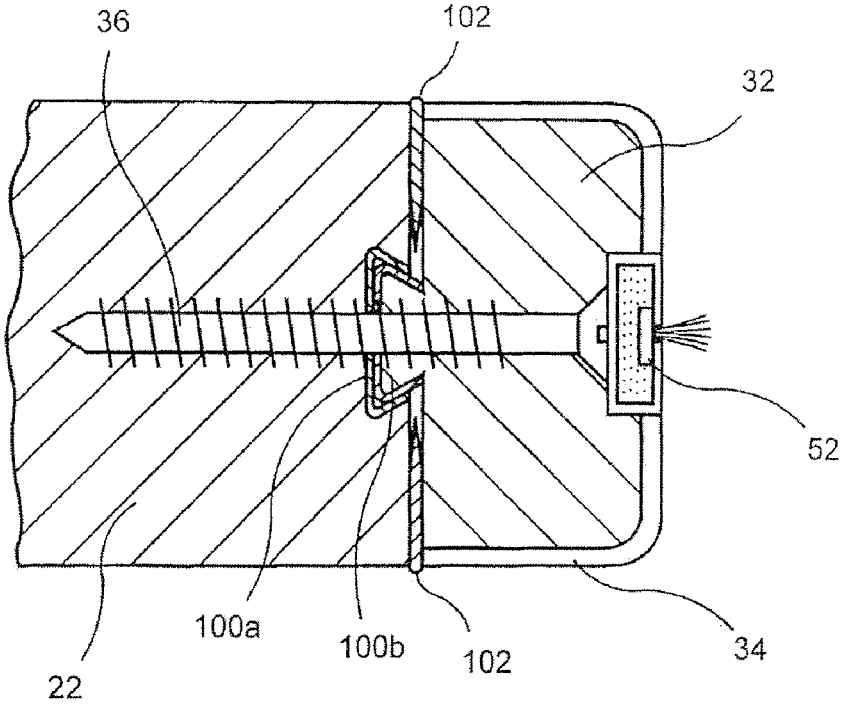
FIG. 10 illustrates a modification of the arrangement of FIG. 9.

A variation of the embodiment of FIG. 9 is shown in FIG. 10, in which the extents of the metal channels 100*a* and 100*b* are limited to the extents of the groove and tongue, respectively. The space left between stile 22 and replaceable stile 32 is filled with tapered inserts 102, which serve to wedge the members 22, 32 apart and also to provide accent strips.

Figure 11:
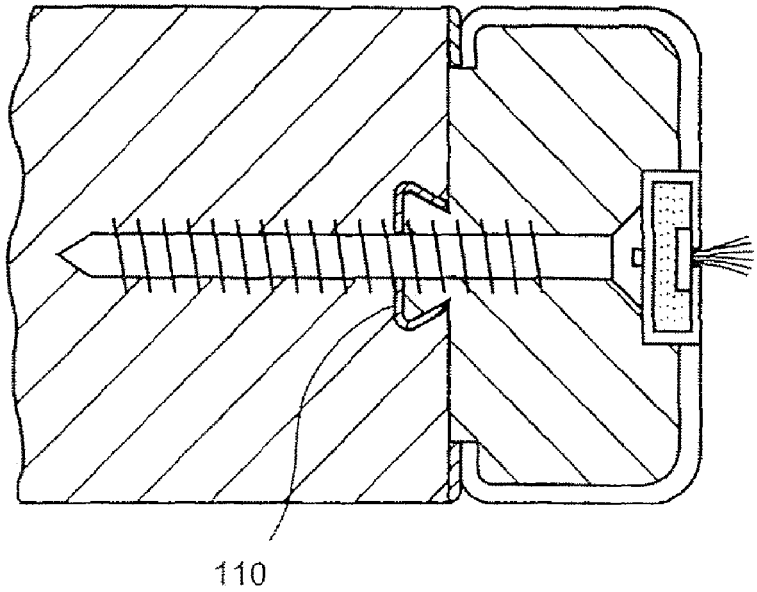
FIGS. 11 and 12 illustrates variations of the arrangement of FIG. 9.
Figure 12:
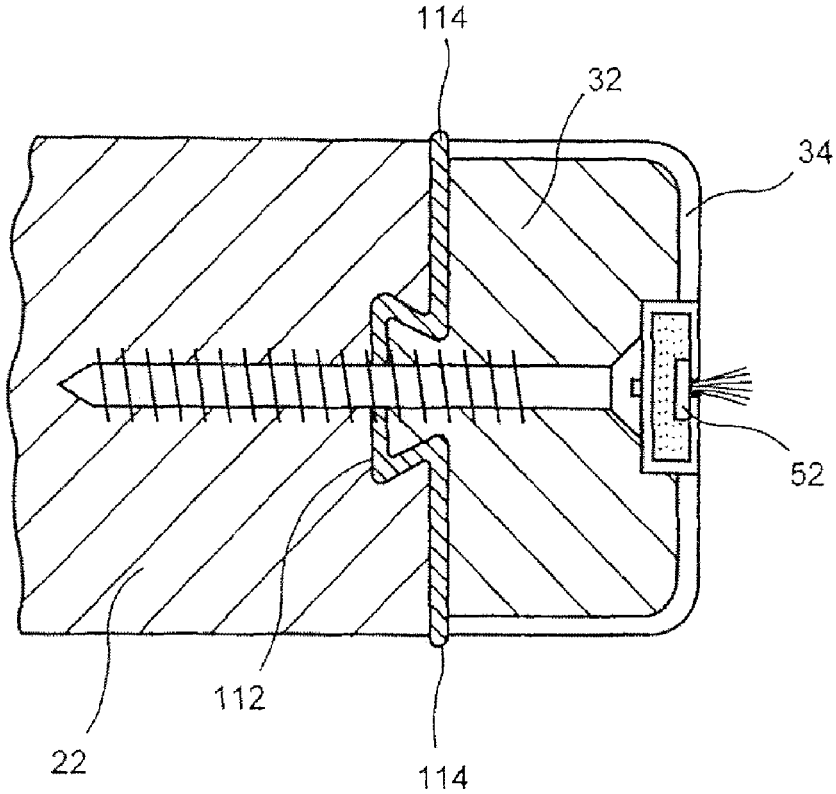

In FIG. 10, a single metal channel 110 is applied to the dovetail tongue element only and in FIG. 11, the single metal channel 112 is extended outwardly between stile 22 and replaceable stile 32 to the door faces with rounded outer edges 114 which provide accent strips.

Figure 13:
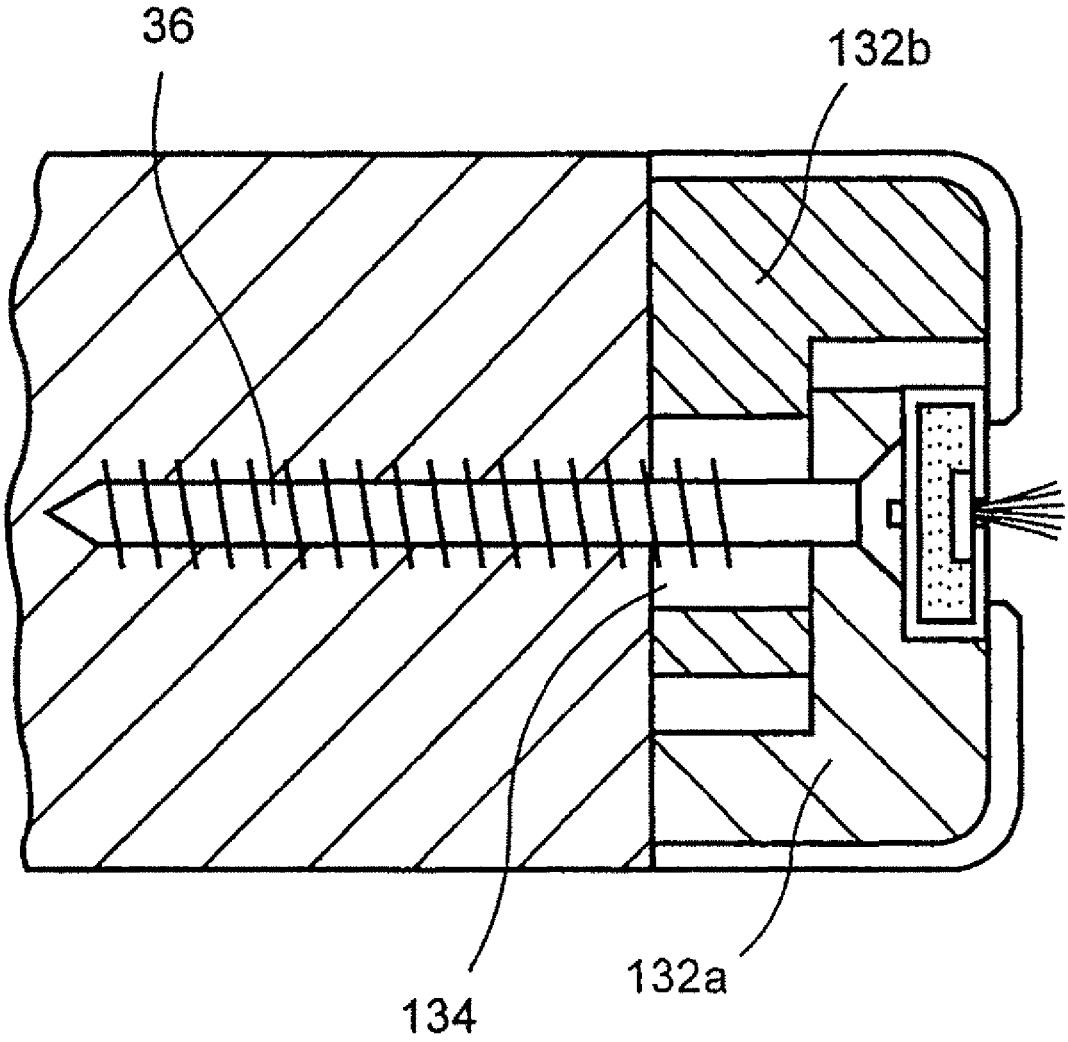
FIG. 13 illustrates a replaceable stile arrangement in accordance with the invention in which the width of the replaceable stile is adjustable.

To accommodate different door thicknesses, the adjustable width replaceable stile of FIG. 13 is advantageous. In this embodiment, the replaceable stile is made up of two separate longitudinal elements 132*a* and 132*b*, each having a generally L-shaped cross-section overlying and nesting with each other to be slideable away from each other between a minimum width arrangement wherein the respective longitudinal edges of elements 132*a* and 132*b* are in contact with each other and a maximum width configuration wherein the respective longitudinal edges are separated. Opening 134 is of greater diameter than screw 36 to allow for varying amounts of separation.

It will be seen from the foregoing that the present invention provides a simple, inexpensive way of repairing damaged doors by allowing replacement only of a removable door edge assembly, thereby saving the considerable exposure of replacing an entire door. Although a number of specific embodiments of the invention above have been illustrated, various modifications thereof will be apparent to those skilled in the art within the spirit of the invention. For example, replaceable stile 32 and cover 34 may be made as a single integral member and joined to stile 22 as shown. Also, the tongue-and-groove coupling between replaceable stile 32 and stile 22 may be eliminated, if desired and any of these variations may be provided with or without intumescent strips. Accordingly, it will be evident that the scope of the invention is to be limited only as set forth in the appended claims.

We claim:

1. Edge construction for a door, the door having a first edge and a second edge, the edge construction comprising:

a core member;

a first stile member permanently attached to the core;

a second replaceable stile member disposed adjacent to the first stile member, wherein a gap is defined between the first stile member and the second stile member; and a cover having outer edges disposed over at least part of the second stile member, the outer edges disposed in the gap and spaced from the first stile member to define an exposed surface.

2. The door edge construction of claim 1, wherein the exposed surface is of a color different than the color of at least the cover or a remainder of the door.

3. The door edge construction of claim 1, further comprising at least one accent strip disposed between the first stile member and the cover.

4. The door edge construction of claim 3, wherein the accent strip is of a color different than the color of at least the cover or a remainder of the door.

5. The door edge construction of claim 3, wherein the accent strip is disposed in a slot formed between the first stile member and the cover.

6. The door edge construction of claim 5, wherein the slot is formed in the second stile member.

7. The door edge construction of claim 5, wherein the accent strip is an L-shaped member.

8. The door edge construction of claim 7, further comprising a lateral slot formed in the second stile member, wherein the L-shaped member includes one edge received by the slot disposed between the first stile member and the cover and a second edge received in the lateral slot.

9. The door edge construction of claim 3, wherein the accent strip is sandwiched between the first and second stile members such that the accent strip includes at least one exposed surface.

10. The door edge construction of claim 3, wherein the door edge construction includes opposing panels and a width defined therebetween, the accent strip configured as a unitary member extending across the width of the door edge.

11. The door edge construction of claim 3, wherein the accent strip is composed of plastic or metal.

12. The door edge construction of claim 1, wherein the cover is readily removable from the second stile member.

13. The door edge construction of claim 1, further comprising a non-permanent fastening means releasably securing the second stile member to the first stile member.

14. In a rectangular door having opposing panels, a width defined therebetween, and vertical edges, an edge construction for a vertical edge of the door comprising:

a first stile member permanently attached to the vertical edge, the first stile member including a longitudinal groove formed in an outer surface thereof;

a removable second stile member disposed adjacent to the first stile member and having a longitudinal spline, wherein a gap is defined between the first stile member and the second stile member;

the spline mating with the groove in the first stile member to form a tongue-and-groove coupling between the first stile member and the second stile member; and a cover having outer edges, the cover disposed over at least part of an outer surface of the second stile member, the outer edges of the cover disposed in the gap and spaced from the first stile member to define an exposed surface therebetween.

15. The edge construction of claim 14, wherein the exposed surface is of a color different than at least the cover or a remainder of the rectangular door.

16. The door edge construction of claim 14, further comprising at least one accent strip.

17. The door edge construction of claim 16, wherein the accent strip is disposed between the cover and the first stile member.

18. The door edge construction of claim 16, wherein the accent strip is of a color different than at least the panels or the cover of the door.

19. The door edge construction of claim 16, wherein the accent strip is a unitary member extending across the width of the rectangular door.

20. The door edge construction of claim 14, wherein the cover is removable from the second stile member.

21. The door edge construction of claim 14, further comprising a non-permanent fastening means releasably securing the second stile member to the first stile member.

22. A door edge construction comprising:

a core member;

a first stile member permanently attached to the core;

a second stile member disposed adjacent and exterior to the first stile member, the second stile member extending along a length of the first stile member, the second stile member non-permanently secured to the first stile member such that it is readily removable and replaceable, the second stile member including indents formed on opposite sides thereof, the indents extending longitudinally along a length of the first stile member; and a cover having inwardly directed flanges, the cover disposed over at least part of an outer surface of the second stile member, the inwardly directed flanges of the cover received within the indents in the second stile member.

23. The door edge construction of claim 22, further comprising at least one accent strip.

24. The door edge construction of claim 23, wherein the accent strip is disposed between the cover and the first stile member.

25. The door edge construction of claim 22, wherein the cover is removable from the second stile member.

26. The door edge construction of claim 22, wherein the flanges are disposed at the edges of the cover.

27. The door edge construction of claim 22, wherein the first stile member has a groove to receive a spline of the second stile member.

28. The door edge construction of claim 22, wherein an adhesive couples the first stile member to the second stile member.

29. The door edge construction of claim 22, wherein the outer edges of the cover are disposed in contact with a portion of the first stile and the second stile.

* * * * *